US007015656B2

(12) United States Patent
Wang

(10) Patent No.: US 7,015,656 B2
(45) Date of Patent: Mar. 21, 2006

(54) DIMMING CIRCUIT FOR A GAS-DISCHARGE LAMP

(75) Inventor: Ching-Nan Wang, Chang-Hua (TW)

(73) Assignee: Chuan Shih Industrial Co., Ltd., (TW)

( * ) Notice: Subject to any disclaimer, the term of this patent is extended or adjusted under 35 U.S.C. 154(b) by 0 days.

(21) Appl. No.: 10/833,103

(22) Filed: Apr. 28, 2004

(65) Prior Publication Data

US 2005/0179405 A1 Aug. 18, 2005

(51) Int. Cl.
*H05B 37/02* (2006.01)

(52) U.S. Cl. ..... 315/291; 315/307; 315/DIG. 4

(58) Field of Classification Search ..... 315/291, 315/307, DIG. 4, DIG. 7, 224
See application file for complete search history.

(56) References Cited

U.S. PATENT DOCUMENTS 5,422,547 A * 6/1995 Brownell ..... 315/DIG. 4
5,949,197 A * 9/1999 Kastner ..... 315/291
6,288,630 B1 * 9/2001 Bardouillet ..... 315/DIG. 4
2002/0101193 A1 * 8/2002 Farkas et al. ..... 315/291

* cited by examiner

*Primary Examiner*—Tuyet Vo
*Assistant Examiner*—Ephrem Alemu
(74) *Attorney, Agent, or Firm*—Bacon & Thomas, PLLC

(57) ABSTRACT

A dimming circuit for a gas-discharge lamp includes a first terminal and a second terminal for inputting AC power, a variable resistor and a capacitor connected with the respective first end to each other and the respective second end to the first input terminal and the second input terminal respectively, a bi-directional diode connected with one end to the first end of the variable resistor and the first end of the capacitor, a TRIAC, which has the gate thereof connected to the second end of the bi-directional diode and one end connected to the second input terminal, and a switch connected in series between the second input terminal and the capacitor for circuit on/off control, for enabling the light intensity of the gas-discharge lamp to be regulated subject to change of the resistance value of the variable resistor.

3 Claims, 2 Drawing Sheets

DIMMING CIRCUIT FOR A GAS-DISCHARGE LAMP

BACKGROUND OF THE INVENTION

1. Field of the Invention

The present invention relates to a gas-discharge lamp and more specifically, to a dimming circuit for controlling the light intensity of a gas-discharge lamp.

2. Description of the Related Art

Conventionally, the adjustment of the light intensity of a lamp, for example, incandescent lamp or halogen lamp, is made directly through a dimmer. The dimmer regulates the light intensity of the lamp by controlling the current passing to the lamp bulb. However, this dimmer is not suitable for use to regulate the light intensity of a gas-discharge lamp (power-saving lamp bulb, fluorescent lamp tube) because the gas-discharge lamp is unstable and may burn out during low output, and the gas-discharge lamp may burn out when regulating the light intensity at this time. Therefore, few light regulation circuits or devices are seen in the market.

SUMMARY OF THE INVENTION

The present invention has been accomplished under the circumstances in view. It is the main object of the present invention to provide a dimming circuit of a gas-discharge lamp, which controls the light intensity of the gas-discharge lamp stably.

It is another object of the present invention to provide a dimming circuit of a gas-discharge lamp, which prevents burning out of the gas-discharging lamp when regulating the light intensity of the gas-discharge lamp.

The dimming circuit of a gas-discharge lamp comprises a first terminal and a second terminal for inputting AC power; a variable resistor, the variable resistor having a second end connected to the first input terminal; a capacitor, the capacitor having a first end connected to the first end of the variable resistor and a second end connected to the second input terminal; a DIAC diode, the DIAC diode having a first end connected to the first end of the variable resistor and the first end of the capacitor, and a second end; a TRIAC, the TRIAC having the gate thereof connected to the second end of the bi-directional diode, a first end connected to the second input terminal, and a second end; and a switch connected to one of the first input terminal and the second input terminal for circuit on/off control, for enabling the light intensity of the gas-discharge lamp to be regulated subject to change of the resistance value of the variable resistor.

DETAILED DESCRIPTION OF THE INVENTION

Figure 1:
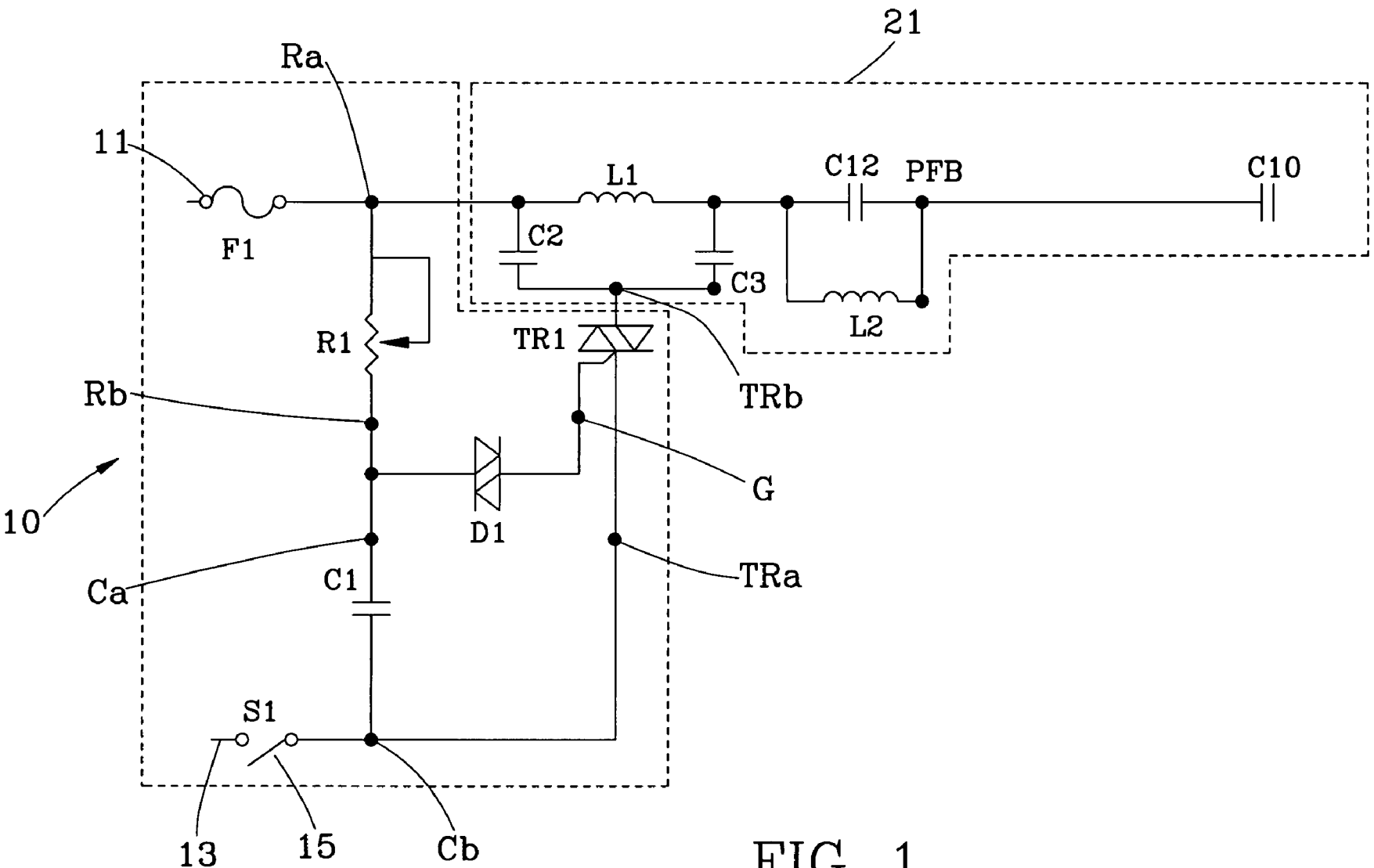
FIG. 1 is a circuit diagram of a light regulating circuit according to the present invention.

Referring to FIG. 1, a light regulating circuit 10 in accordance with the present invention is shown comprising a first input terminal and a second input terminal 11, 13, a variable resistor R1, a capacitor C1, a DIAC diode D1, a TRIAC TR1, and a switch 15.

The first and second input terminals 11, 13 are connected to city power supply for inputting AC power.

The variable resistor R1 has a first end Ra connected to the capacitor C1, and a second end Rb connected to the first input terminal 11. The capacitor C1 has a first end Ca connected to the first end Ra of the variable resistor R1, and a second end C2 connected to the second input terminal 13.

The DIAC diode D1 has one end connected to the first end Ra of the variable resistor R1 and the first end Ca of the variable capacitor C1.

The TRIAC TR1 has the gate connected to the other end of the bi-directional diode D1, and the first end TRa connected to the second input terminal 13.

The switch 15 is connected in series between the second input end 13 and the variable capacitor C1, and adapted to control on/off of the whole circuit.

The invention further comprises a fuse 17 and a phase feedback control circuit 21. The fuse 17 is connected in series between the first input terminal 11 and the variable resistor R1 for overcurrent protection, and a phase feedback control circuit 21, The phase feedback control circuit 21 comprises a first inductance L1, which has one end connected to the first input terminal 11, a second capacitor C2 and a third capacitor C3 connected in parallel between the two ends of the first inductance L1 and the second end TRb of the TRIAC TR1, a fourth capacitor C12 connected in parallel to a second inductance L2 and connected with one end to the other end of the first inductance L1, and a fifth capacitor C10 connected to the other end of the fourth capacitor C12.

Figure 2:
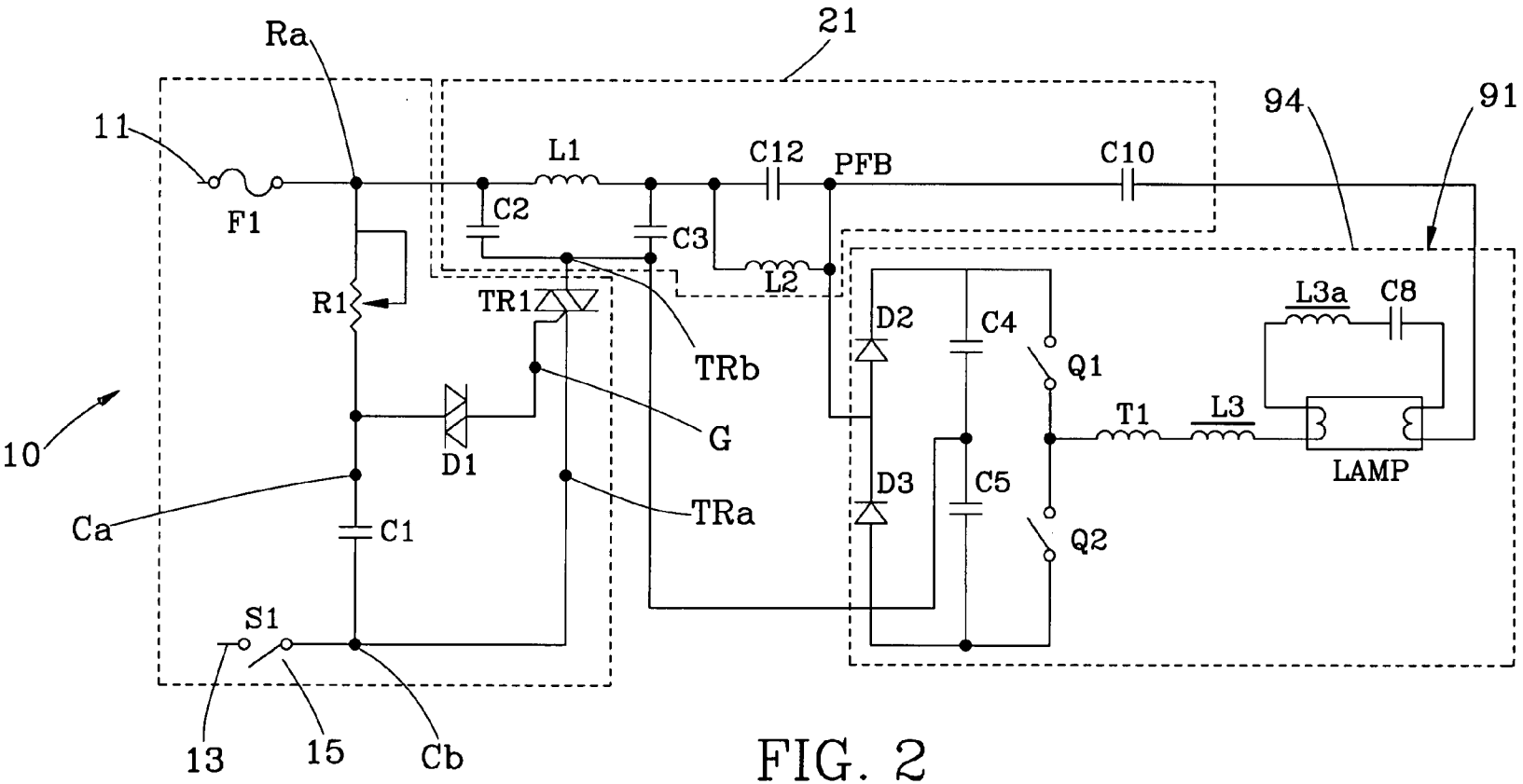
FIG. 2 is a circuit diagram showing the light regulating circuit connected to the circuit of a gas-discharge lamp according to the present invention.

Referring to FIG. 2, a gas-discharge lamp 91 is connected between the second end TRb of the TRIAC TR1 and the fifth capacitor C10.

Referring to FIG. 2 again, the light regulating circuit of the present invention is used with a gas-discharge lamp 91. FIG. 2 shows the circuit connection of the light regulating circuit connected to a gas-discharge lamp 91. The gas-discharge lamp 91 comprises a voltage regulation circuit 94. The second end Rb of the variable resistor R1 and the second end TRb of the TRIAC TR1 are connected to the two opposite ends of the second capacitor C2 of the phase feedback control circuit 92. Thus, by means of charging and discharging action at the ends of the variable capacitor C1, the gate of the TRIAC TR1 is triggered, increasing the conduction time of the TRIAC TR1 and changing the voltage at the ends of the second capacitor C2 without affecting stable power input, and therefore the voltage is stabilized. Further, the lamp tube current gives a feedback voltage through the fifth capacitor C10. The feedback voltage is sent through the fourth capacitor C12 and the second inductance L1 to the inputted AC voltage at the third capacitance C3, and therefore phase feedback control is done. Because the voltage inputted into the diode D2 and capacitor C4 of the voltage regulation circuit 94 of the gas-charge lamp 91 is stable and the oscillation frequency is stable too, the two transistors Q1, Q2 of the voltage regulation circuit 94 work smoothly and stably. By means of changing the value of the variable resistor R1 to regulate the passing current, the light intensity of the gas-discharge lamp 91 is relatively regulated.

As stated above, the invention achieves the following advantages:

1. Adjustment of the light intensity of the gas-discharge lamp: By means of adjusting the resistance value of the variable resistor, the light intensity of the gas-discharge lamp is relatively regulated.

2. Improvement of light regulation stability: Because the light regulating circuit can stabilize the voltage, light regulation stability of the gas-discharge lamp at low power is achieved.

A prototype of light regulating circuit of a gas-discharge lamp has been constructed with the features of FIGS. 1 and 2. The dimming circuit of a gas-discharge lamp functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A dimming circuit of a gas-discharge lamp comprising:

a first terminal and a second terminal for inputting AC power;

a variable resistor, said variable resistor having a second end connected to said first input terminal;

a capacitor, said capacitor having a first end connected to a first end of said variable resistor and a second end connected to said second input terminal;

a bi-directional diode, said bi-directional diode having a first end connected to the first end of said variable resistor and the first end of said capacitor, and a second end;

a TRIAC, said TRIAC having a gate thereof connected to the second end of said bi-directional diode, a first end connected to said second input terminal, and a second end;

a switch connected to one of said first input terminal and said second input terminals for circuit on/off control, for enabling the light intensity of the gas-discharge lamp to be regulated subject to change of the resistance value of said variable resistor;

a phase feedback control circuit, said phase feedback control circuit comprising a first inductance, said first inductance having a first end connected to said first input terminal and a second end, a second capacitor and a third capacitor connected in parallel between two opposite ends of said first inductance and the second end of said TRIAC, a second inductance, a fourth capacitor connected in parallel to said second inductance, said fourth capacitor having a first end connected to the second end of said first inductance and a second end, and a fifth capacitor connected to the second end of said fourth capacitor.

2. The dimming circuit as claimed in claim 1, further comprising a fuse connected to one of said first input terminal and said second input terminal for overcurrent protection.

3. The dimming circuit as claimed in claim 1, wherein said switch is connected in series between said second input terminal and said capacitor.

* * * * *